US012752207B2

(12) United States Patent
Eichenbaum

(10) Patent No.: US 12,752,207 B2
(45) Date of Patent: Oct. 6, 2026

(54) METHOD FOR CONNECTING/DISCONNECTING HINGED BALL AND SOCKET BLOCKS

(71) Applicant: Daniel A Eichenbaum, Pittsburgh, PA (US)

(72) Inventor: Daniel A Eichenbaum, Pittsburgh, PA (US)

( * ) Notice: Subject to any disclaimer, the term of this patent is extended or adjusted under 35 U.S.C. 154(b) by 0 days.

(21) Appl. No.: 18/741,718

(22) Filed: Jun. 12, 2024

(65) Prior Publication Data

US 2025/0083063 A1 Mar. 13, 2025

Related U.S. Application Data

(63) Continuation-in-part of application No. 18/645,823, filed on Apr. 25, 2024, and a continuation-in-part of application No. 29/905,488, filed on Oct. 20, 2023, and a continuation-in-part of application No. 29/901,893, filed on Sep. 6, 2023.

(51) Int. Cl.
*A63H 33/04* (2006.01)
*A63H 33/06* (2006.01)

(52) U.S. Cl.
CPC ..... *A63H 33/042* (2013.01); *A63H 33/062* (2013.01)

(58) Field of Classification Search
CPC ... F16C 11/06; F16C 11/0619; F16C 11/0623; F16C 11/0685; F16C 11/069; F16C 11/106; B23P 11/00; B23P 19/00; A63H 33/042; A63H 33/062; A63H 33/101
USPC ..... 446/107, 116, 121, 120, 85, 108, 124
See application file for complete search history.

(56) References Cited

U.S. PATENT DOCUMENTS 5,368,461 A * 11/1994 Murphy ..... E04F 21/1655 401/266
5,771,650 A * 6/1998 Williams ..... F16B 5/0642 52/568

(Continued)

*Primary Examiner* — Sarang Afzali
*Assistant Examiner* — Darrell C Ford
(74) *Attorney, Agent, or Firm* — Gary P. Topolosky

(57) ABSTRACT

A method for connecting and disconnecting two blocks, a first block having at one end a socket for accepting a ball protrusion from a second block. The first block includes a plurality of elongate clip arms which when squeezed towards one another assist with: (i) insertion of the ball protrusion of the second block into the socket of the first block, and with (ii) removal of the ball protrusion of the second block from the socket of the first block. The method comprises: providing a pair of blocks for connecting to and disconnecting from one another; then when connecting the first block to the second block: situating the ball protrusion of the second block adjacent the socket of the first block; squeezing the plurality of elongate clip arms on the first block towards one another; inserting the ball protrusion of the second block into the socket of the first block; and discontinuing the squeezing of the plurality of elongate clip arms on the first block to connect the first block to the second block. When disconnecting the first block connected to the second block, the method include squeezing the plurality of elongate clip arms on the first block towards one another; removing the ball protrusion of the second block from the socket of the first block.

9 Claims, 6 Drawing Sheets

(56) References Cited

U.S. PATENT DOCUMENTS

| | | | | | |
|---|---|---|---|---|---|
| 5,984,756 | A * | 11/1999 | Krog | A63H 33/10 | 446/120 |
| 6,126,506 | A * | 10/2000 | Rudy | A63H 33/082 | 446/124 |
| 6,665,993 | B2 * | 12/2003 | Sorensen | A63H 33/062 | 446/120 |
| 8,651,914 | B2 * | 2/2014 | Sisamos | A63H 33/101 | 446/85 |
| 10,478,741 | B2 * | 11/2019 | Heo | A63H 33/062 | |
| 2003/0036333 | A1 * | 2/2003 | Oakley | A63H 33/042 | 446/85 |
| 2003/0186616 | A1 * | 10/2003 | Manville | A63H 33/101 | 446/85 |
| 2008/0261484 | A1 * | 10/2008 | Culpepper | A63H 3/16 | 446/124 |
| 2020/0191187 | A1 * | 6/2020 | Heo | A63H 33/062 | |

* cited by examiner

METHOD FOR CONNECTING/DISCONNECTING HINGED BALL AND SOCKET BLOCKS

CROSS-REFERENCE TO RELATED APPLICATIONS

This application is a continuation-in-part of U.S. Design patent application Ser. No. 29/901,893, filed on Sep. 6, 2023, Ser. No. 29/905,488, filed on Oct. 20, 2023, and U.S. Utility patent application Ser. No. 18/645,023, filed on Apr. 24, 2024, all three disclosures of which are fully incorporated by reference herein.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

(1) Field of the Invention

The present invention relates to a set of interlocking or interconnecting blocks in varying shapes and sizes. Particularly, it relates to a set of blocks/block shapes that perform unique connecting means by using a multi-sectional hinged end for interacting with the balled end of an adjoining block. With such hinged end sections of two or more elements, these block systems allow for easier actuation to connect and disconnect, by hand actuation, mechanical servos, actuators and the like.

Toy building blocks are generally well known. Such building block sets are often an important part of a child's learning and development process. Conventional building block sets allow children to use their imagination to creatively build/assemble a generally limitless number of configurations and/or structures. Conventional toy building block sets may include a variety of differently sized and/or shaped blocks. Some block sets employ varying degrees of attraction and/or removal forces to attach or detach blocks from adjoining neighbor blocks.

(2) Description of Related Art Including Information Disclosed Under 37 CFR 1.97 and 1.98

Not Applicable.

BRIEF SUMMARY OF THE INVENTION

A ball and socket based connecting block system is disclosed in which each connecting block includes at one end a socket side for fitting on or about a ball end of an adjoining or neighboring connecting block to at least temporarily join the two blocks together in a rotatable manner. A more planar version of socket side includes a central shaft element that terminates in a female recess for fitting onto or about a ball-shaped protrusion of an adjoining block to at least temporarily "lock" the two blocks together. At an innermost curvature of this female recess, there is provided an inwardly, upwardly projecting T-shaped split. That split allows for some lateral expansion of the central shaft to accommodate the ball-shaped protrusion of the adjoining block in the female recess of the connecting block.

On opposed sides to the central shaft of this connecting block, there is provided a set of squeezable elongate clip arms adapted for manipulating towards one another to hinge the block sufficiently open, in conjunction with the aforementioned T-split for easier removal/extraction of the adjoining block's ball protrusion from within the connecting block's female recess.

In a first, more planar version of connecting block, the central shaft element terminates at one end into that block's ball joint protrusion to resemble somewhat of an A-shaped variety of connecting block. In a second variation, there are female recesses at both ends of the central shaft element to give the block more of an X-shape in top view.

In more three-dimensional, radially symmetric variations, with curved/spherical sides to a connecting block having a plurality of circular, cylindrical series of cross sections, the connecting block version consists of its own socket end side with a spherically curved (female) recess into which an adjoining block's ball shaped protrusion is inserted/snapped into place. That socket end has a cylindrical shaft with a lowermost edge having two or more T-shaped splits that extend upwardly and inwardly. Like in the more planar version above, these T-splits provide some flexibility so as to allow for some lateral movement when squeezed towards one another so as to: (a) more easily fit the adjoining block's ball protrusion INTO this block's recess when first joining the two blocks together; and (b) assist in sufficiently extracting that same block's ball protrusion FROM the main block's female recess when intending to separate the two blocks from one another.

Each female recess of these radially symmetric variations, at only one end in FIGS. 3A through C, and at both top and bottom (or left and right) ends in FIGS. 3D and E, there are a plurality of curved aprons. When joined together, these aprons form the basis of a recess/feed in area for the adjoining block's ball shaped protrusion, i.e., the three-dimensional equivalent of the more planar version's elongate clip arms. The cone-like bottom end will need at least two hinged aprons, though it is to be understood that other models may be divided, preferably equally, into 3, 4, possibly even 5 or 6, hinged apron sections. See FIGS. 4A and B for a representative 4 apron variation. Such hinge joints, located around the circumference of these female recesses, allow the socket portion to open and close when actuated by hand (squeeze grip), a mechanical servo or actuator.

The opening and closing of these female sockets have three main benefits: 1) they allow for easy separation or connection of the ball-and-socket when the socket is hinged open; 2) they allow for the socket to retain the ball portion when closed; and 3) they allow for variable compression of the socket on the ball portion with variable compressive force: i.e., less compression allows the ball to be retained by the joint but still rotate/pivot within the socket while higher socket compression grips the ball firmly and restricts its movement. This invention further relates to a set of mostly rectilinear, polyhedron blocks, both building and connecting style, several models of which include a ball joint-like component on at least one end. These building blocks are configured and/or designed to have a predetermined, generally consistent attraction and/or removal force between various sized and shaped blocks. The invention still further relates to both toy and non-toylike end uses for these same block sets.

In addition to somewhat planar building blocks in the shape of an A or X-shape, this invention includes more spherical or rounded connector blocks that are either A-shaped or X-shaped. Specifically, it would be desirable to create a set of specially shaped toy building blocks that includes families of interconnecting shapes that resemble a PLUS (+) sign along with the letters A, X, I, O and Y, tentatively marketed under the AXIO Block™ brand.

A method for connecting and disconnecting two blocks, a first block having at one end a socket for accepting a ball protrusion from a second block. The first block includes a plurality of elongate clip arms which when squeezed towards one another assist with: (i) insertion of the ball protrusion of the second block into the socket of the first block, and with (ii) removal of the ball protrusion of the second block from the socket of the first block. The method comprises: providing a pair of blocks for connecting to and disconnecting from one another; then when connecting the first block to the second block: situating the ball protrusion of the second block adjacent the socket of the first block; squeezing the plurality of elongate clip arms on the first block towards one another; inserting the ball protrusion of the second block into the socket of the first block; and discontinuing the squeezing of the plurality of elongate clip arms on the first block to connect the first block to the second block. When disconnecting the first block connected to the second block, the method include squeezing the plurality of elongate clip arms on the first block towards one another; removing the ball protrusion of the second block from the socket of the first block.

BRIEF DESCRIPTION OF THE SEVERAL VIEWS OF THE DRAWING(S)

The following summary will be better understood when read in conjunction with the appended drawings in which.

DETAILED DESCRIPTION OF THE INVENTION

Figure 1C:
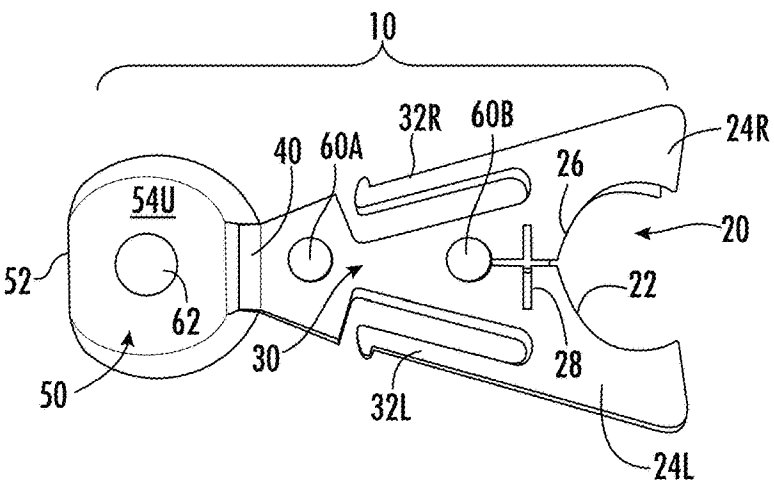
FIG. 1C is a top plan view of the same connector block per FIGS. 1A and B.

Certain terminology is used in the following description for convenience only and is not limiting. The words "right," "left," "upper," and "lower" designate directions in the drawings to which reference is made. The words "first" and "second" designate an order or operations in the drawings to which reference is made, but do not limit these steps to the exact order described. The words "inwardly" and "outwardly" refer to directions toward and away from, respectively, the geometric center of the blocks and/or set and designated parts thereof. The term "multi-" is defined herein as "three or more." Additionally, the terms "a," "an" and "the," as used in the specification, mean "at least one." The terminology includes the words specifically mentioned above, derivatives thereof, and words of similar import.

In the accompanying FIG's, common elements are commonly numbered between embodiments/versions though sometimes in the next hundred series. For example, a female end may be numbered 20 in a first embodiment but 120 for a second embodiment, 220 for a third, 320 for a fourth and so on. Note, the commonality of component parts such as recesses X22, T-joints X28, shaft elements X30 and ball joints X50 to name a few, are also consistently numbered in the next hundred series even in not expressly spelled out hereinbelow.

Figure 1B:
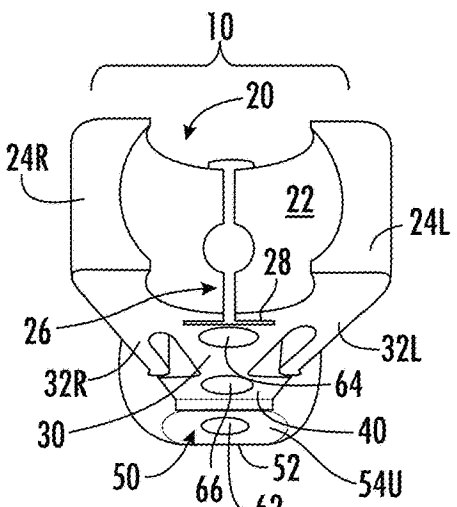
FIG. 1B is a back, axial perspective view of the same A-shaped connector block or 180-degree, opposite view from that shown in FIG. 1A.
Figure 1A:
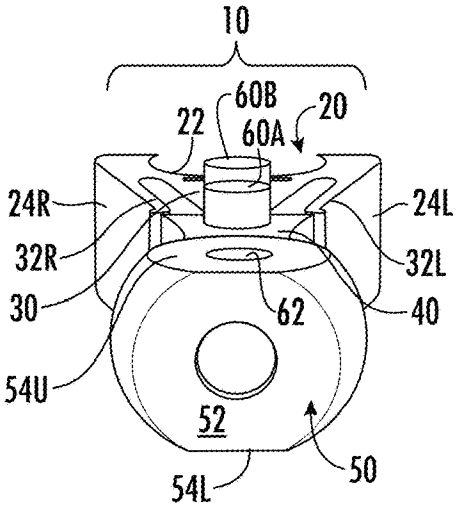
FIG. 1A is a front, axial perspective view of one embodiment of more planar, A-shaped connector block per the present invention.

In FIGS. 1A through C, there is shown a first version of building/connector block, generally 10, having a first end 20 with an inwardly curved female recess 22. On either side of that recess is a left and right footing, 24L and R, respectively. At an innermost curve 26 of female recess 22, there is extended at T-shaped expansion joint 28. It allows for/accommodates some side-to-side (i.e., lateral) movement of the female recess 22 when both accepting the ball projection of an adjoining block INTO that recess . . . and for moving slightly apart when extracting that same adjoining block ball projection OUT FROM that same female recess 22.

To better assist with the insertion and removal of another block's ball projection (not shown) from this female recess 22, from a central most shaft element 30, there would extend a pair of each connector block further includes a pair of springlike, elongate clip arms 32L and R, that when squeezed towards one another serve to provide hinging capabilities to the block proper.

In the first block version depicted at FIGS. 1A through C, there is a top joinder 40 of shaft element 30 to a ball joint component 50 at the end opposite first end 20. Note, that it is not a full spherical ball but rather has a flat top 52 and flat upper and lower sides 54U and 54L.

Also, in the A-shaped version shown at FIGS. 1A through C, there are a plurality of upwardly protruding connector block posts 60A and B for connecting block no. 1 (10) to one or more adjoining blocks 2, 3—perhaps using post recesses like those shown at items 62 in the flat top 52 of ball joint component 50 and recess 64 in lower side 54L of ball joint component 50. Some representative recesses 66 are also drawn into the main body of shaft element 30.

Figure 2:
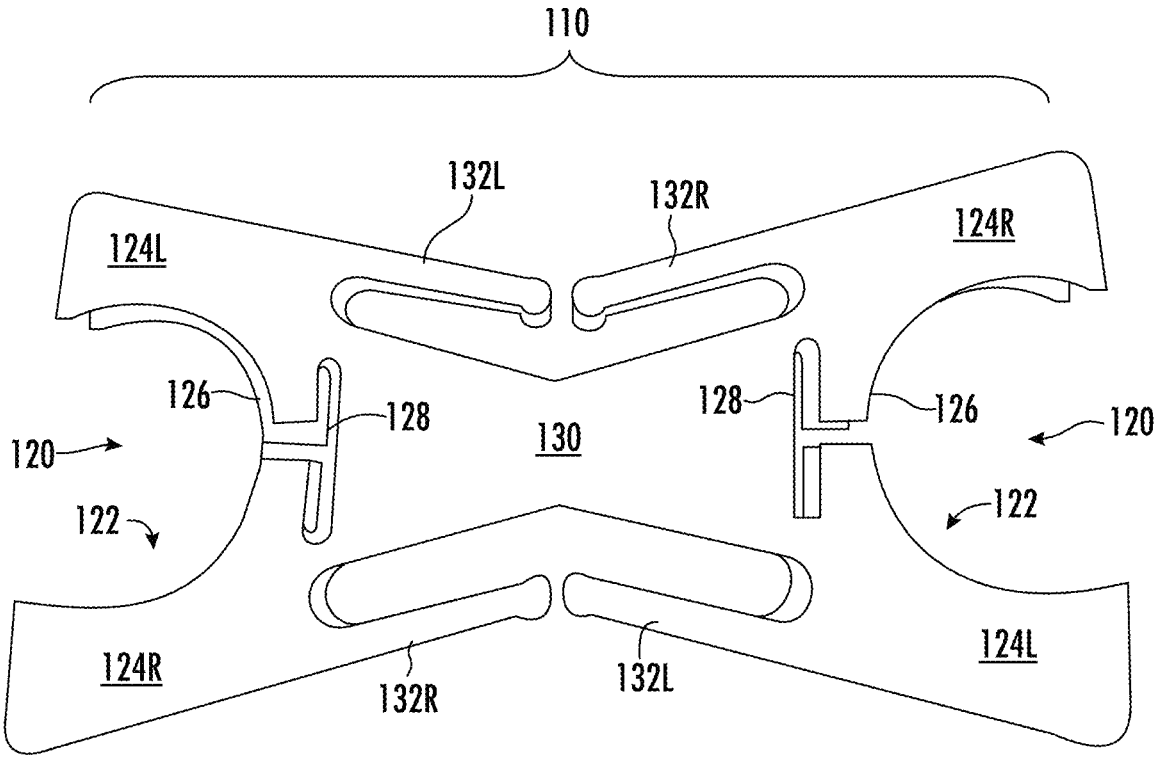
FIG. 2 is a top plan view of a more planar, X-shaped connector block per a second embodiment, said X-shaped connector being more of a double sided, female at both ends.

In FIG. 2, there is shown a second version of flat/planar connector 110 which includes a female end 120 at both ends of shaft element 130. It gives the overall appearance of an X-shape for connecting to the ball projection of an adjoining connector block FROM EITHER END of X-shaped connector 110.

Figure 3C:
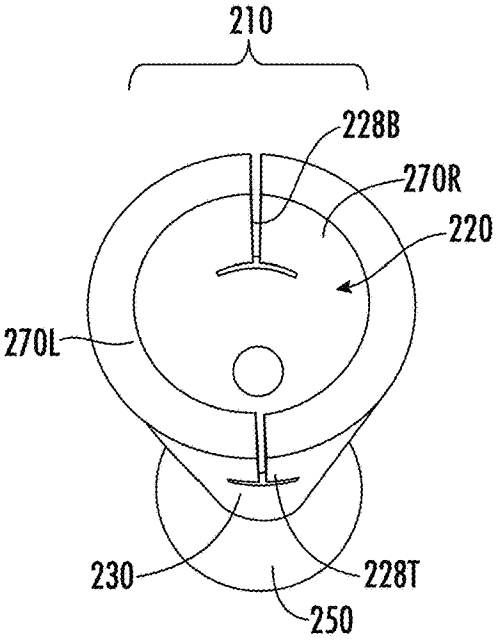
FIG. 3C is a back, axial perspective view (socket end) of the same A-shaped connector block or 180-degree, opposite view from that shown in FIG. 3A.
Figure 3B:
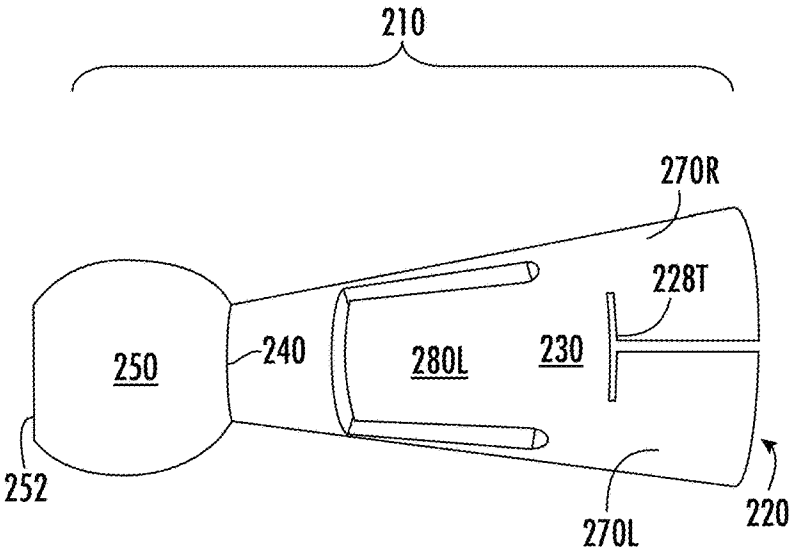
FIG. 3B is a top plan view of the same radially symmetric, i.e., rounded, A-shaped connector block from FIG. 3A.
Figure 3A:
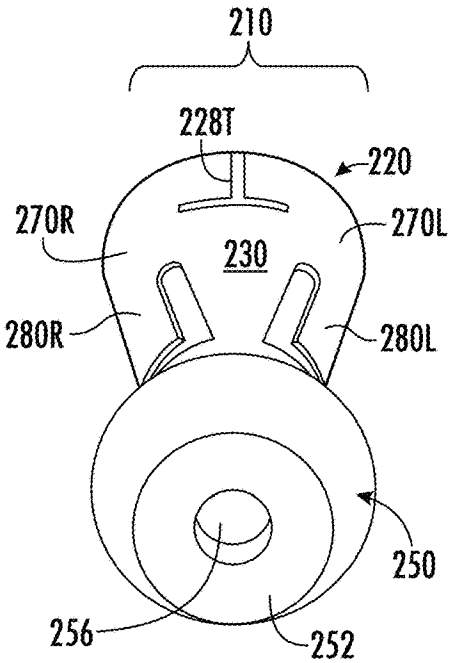
FIG. 3A is a front, axial perspective view (ball end) of one embodiment of radially symmetric, more rounded, A-shaped connector block per this invention, said rounded connector having a spherical ball at one end and a multiple hinged element at its opposite socket end.
Figure 3E:
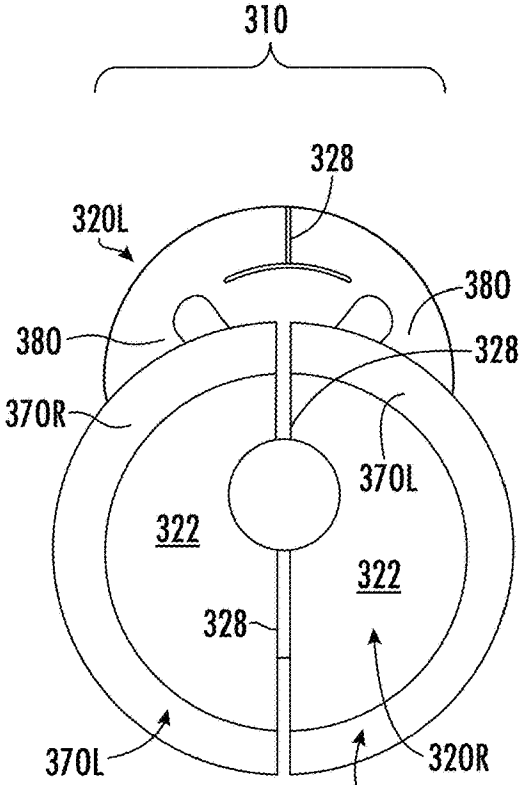
FIG. 3E is an axial perspective view of the socket end (both sides are the same) of the radially symmetric, X-shaped connector block from FIG. 3D.

FIGS. 3A through C show a first embodiment of radially symmetric serves as, more rounded, A-shaped connector 210 having a female end 220 that a receptor for the spherical ball projection (not shown) of an adjoining connector block (also, not shown). Like the more planar A-shaped equivalent (FIGS. 1A through C), this version still has a T-shaped expansion joint—but in this more three-dimensional variation, it is elementally identified as component parts from top 228T AND bottom 228B ends.

FIGS. 3A through C also depict a spherical/cylindrical central shaft 230 from which a plurality (i.e., two or more) of aprons 270L and R, on either side of the T-shaped expansion joints 228T and 228B. And instead of elongate clip arms (items 28 in FIGS. 1 through 3), this version has more of a push in, springlike panels 280L and R-which can be partially pushed in to allow for better installation ON another adjoining block's ball joint protrusion and squeezed in to help remove the main block connector proper 210 when disconnecting from that same ball joint protrusion. Note that in the flat top 252 of spherical head 250 (with NO flat side equivalents), there is only one lone top peg recess 256.

Figure 3D:
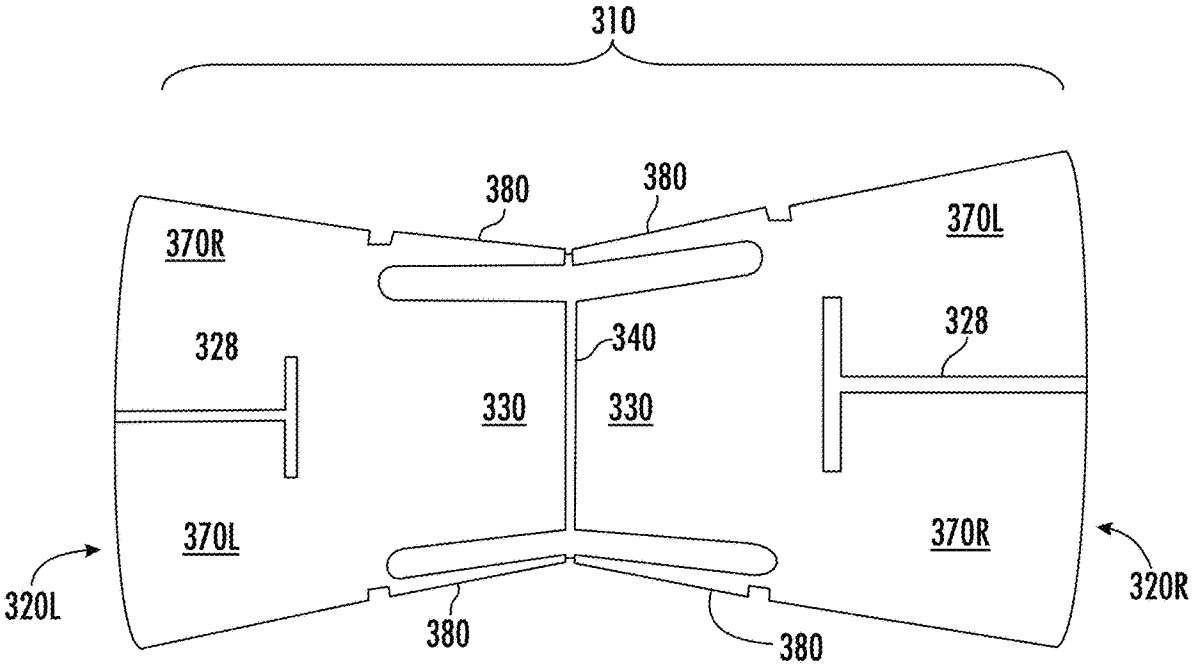
FIG. 3D is a top plan view of another embodiment of radially symmetric, more rounded, X-shaped connector block per this invention.

FIGS. 3D and E show the X-version of radially symmetric connector 310 with matching joints 328 for both female receptor ends, i.e., at the left 320L and right 320R (though they could just as easily be referred to as both top and bottom sub-sections instead. In this first, TWO apron variation, there is also shown a pair of curvy panels 370L and R with a push-in clip arm equivalent at 380.

Figure 4B:
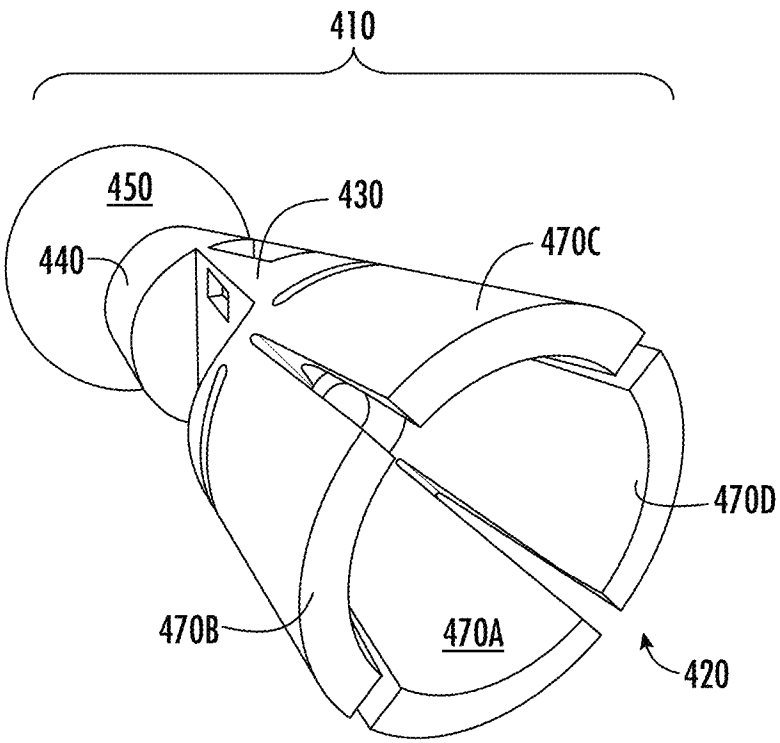
FIG. 4B is a bottom perspective view of the connector block from FIG. 4A.
Figure 4A:
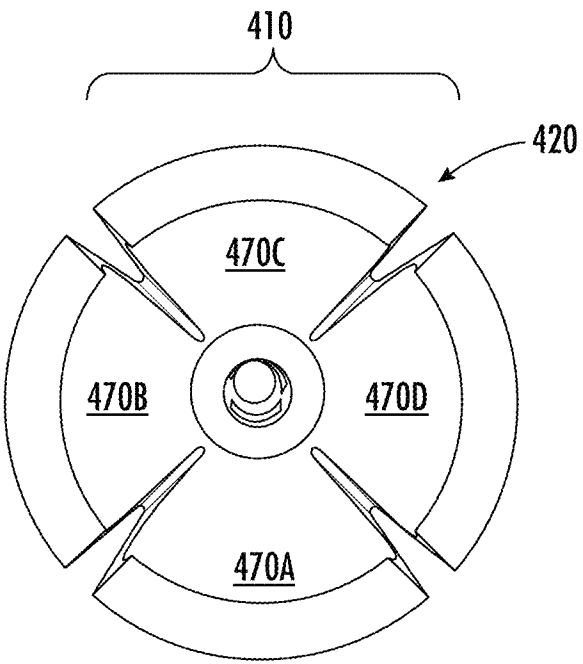
FIG. 4A is a bottom plan view of one embodiment of a radially symmetric, i.e., rounded, A-shaped connector block having four representative apron sections.

FIGS. 4A and B show an alternative embodiment of socket connector 410 having at one end, the socket or female end 420 includes four (4) apron sections/divisions, 470A, B, C and D from a planar, underside view (FIG. 4A) and a lower perspective view (FIG. 4B). While shown with an even number of such curvy apron components, it is understood that the connector bottoms can also be divided into multiple, odd numbered elements, like 3 or 5, and/or more that four, like six or eight, depending on the overall dimensions of said connector block.

Figure 5:
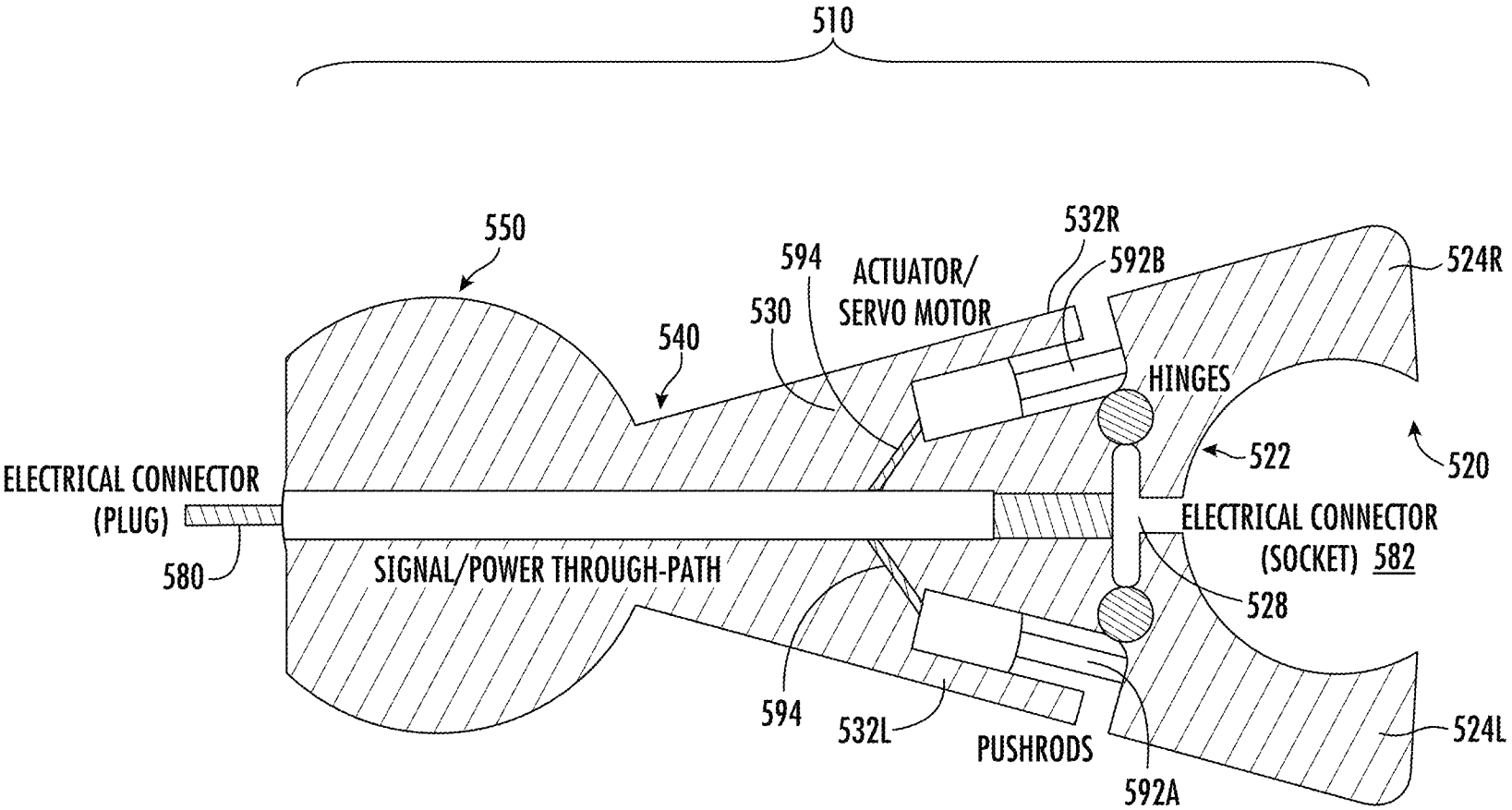
FIG. 5 is a side sectional view of a connector block application with electrical connections at both ends.

FIG. 5 shows a cross sectional view of a connector 510 with a plurality of electrical connector components, i.e., with a plug end 580 and socket end 582, as well as a plurality of servo-motors or actuators 590A and B with their respective pushrods 592A and B. A pair of wires (elements 594) connect these actuators to the connector block's through path to get their signal/power. Such embedded actuators inside the socket end of a ball-and-socket block connect to the main body to the hinged portion of the socket joint. Such actuator movements translate into an opening and closing motion of the socket joint. The number of actuators needed per block will vary. Smaller blocks will likely have 1 or 2 such actuators with larger blocks having many more.

The aforementioned actuators can serve several purposes including: 1) replacing the need for direct human contact to open and close the socket, 2) providing the ability to remotely open and close the socket, 3) provide the ability to precisely vary the tension on the ball-and-socket joint. These actuator elements receive power and control signal through wiring in a central shaft that leads axially through the block. This allows chains of blocks to pass common power and signal cable(s) while still allowing the ball-and-socket joints to pivot/rotate without the cables impeding motion, particularly when multiple components of this invention are connected, block-to-block, in series.

Potential Rope/Cable and Architectural uses for the latter variations include extending an interconnected chain of such blocks to allow support columns or suspension cables with controllable rigidity. That, in turn, could allow future buildings to dampen sway from earthquakes or wind, and/or better absorb the motion of earthquakes or natural ground movement.

Furthermore, motors with drive wheels can be fitted to the spherical ends of these block variations to allow each block to independently position itself. The results could be buildings or building features that bend or twist on demand. Examples include: a skyscraper that twists to follow a sunset; or a building that can alter the curvature or position of its roof: (a) for decorative purposes; (b) to reduce wind forces; and/or (c) to block sunlight.

Rope/Cable

Using the above computer-controlled, variable tension blocks, long "ropes" or "cables" of these blocks could be made and replace typical uses for a load-bearing rope or cable. These blocks could replace support cables on bridges and buildings with the added advantage of being able to control cable flexibility in real-time. Bridge sway can be minimized in such a scheme. Smaller, hand-held sized blocks could be used by people in place of a conventional rope but have the advantage of variable flexibility. With mechanized blocks of sufficiently small size (3 cm length or small) embedded in a fabric or flexible material, the blocks could allow the material to form a rigid shape or collapse/fold as needed. For example: one could conceivably make a cape that can transform from a rigid shape or collapse behind its wearer. There are also potential adjustable airfoil shape applications for aircraft and other vehicles.

Robotic Parts

The ball-and-socket shape allows for the construction of simple graspers and arms for robots and mechanical devices. The adjustable socket end on the main robot body and be opened to allow it to engage a spherical connector on a detachable appendage. Once the robots maneuver the socket over the appendages ball connector, the robot engages the actuators to firmly connect the socket to the ball, thereby allowing the robot to hold the appendage.

Still Other AXIO Blocks Descriptions and Potential End Uses

Description of the Blocks:

Integrated tabs to release tension on the connectors allowing for easy block disconnection. Larger blocks may have an integrated motor and microcontroller to adjust connector tension.

Flat top and bottom of some of the blocks, along with pegs and holes, for easy and strong vertical and right-angle connections.

Ball-and-socket joints would allow for flexibility and rotational/movable connections.

Spherical plugs may be coated in a material to increase friction between the blocks once the tabs are released. This material may be a rubberized coating, ceramic, or composite material possibly applied by co-injection molding.

1. For smaller blocks (approximately 2.5-3.5 centimeters in length, made from injection-molded plastic)

An interlocking building-block toy for children or desk use and decorative objects.

2. For medium or intermediate sized blocks (approximately 6-10 centimeters in length, made from injection-molded plastic, carbon fiber, or metal)

One could make connecting SYSTEMS for audio/video recording and playback devices (such as cameras, video cameras, microphones, speakers), smartphones, and still other portable electronic devices.

Wall mounting ball or cylindrical attachment points could connect to walls, floors, doors, cubicles, vehicles, remote control vehicles/drones, helmets, sporting equipment, selfie sticks. With a spring-clip, AXIO blocks can hold paper documents and clipboards.

This is a hands-free holding/mounting system anywhere an object needs to be securely held in place.

Power and Signal Transfer

A hollow shaft can be molded inside the AXIO block through which electrical cable or drive shaft with universal joints may be fitted. The electrical cable is fitted with plug and socket connectors to allow the cables to connect as separate AXIO blocks are joined together.

Examples of AXIO blocks holding a device and transporting signal/power to it:

A microphone holder with an integrated cable to conduct signal and provide phantom power for the microphone's operation.

3. For large blocks (approximately 50 to 100 centimeters in length)

Landscaping, paving, and retaining bricks that conform to terrain and walls that bend in X, Y, and Z axis as opposed to traditional square bricks. These bricks would be made from molded concrete or composite rubber, concrete, metal, and/or glass.

Blocks of this size could hold larger audio/video equipment, such as televisions/monitors, computers, tablets.

4. For extra-large blocks (over 100 cm in length)

Building construction: Blocks can contain a motorized, semi-spherical connector to adjust tension on connected blocks. A microcontroller with X, Y, and Z axis positioning sensors in the AXIO block with either radio frequency or direct wired connection to a computer that would control each block in concert with the others. A chain of these blocks could allow support columns with controllable rigidity, allowing building to dampen sway from earthquakes or wind or better absorb the motion of earthquakes or natural ground movement. Motors with drive wheels can be fitted to the spherical end allowing each block to independently position itself. The results could be buildings or building features that bend or twist on demand.

Examples: A skyscraper twists to follow a sunset; or building that alters the curvature or position of its roof for decorative purposes or to reduce wind forces or block sunlight.

Still other applications include a rope or cable end uses

Using the above computer-controlled, variable tension blocks, long "ropes" or "cables" of these blocks could be made and replace typical uses for a load-bearing rope or cable. These blocks could replace support cables on bridges and buildings with the added advantage of being able to control cable tension in real-time. Bridge sway can be minimized in such a scheme. With mechanized blocks of sufficiently small size (3 cm length or small) embedded in a fabric or flexible material, the blocks could allow the material to form a rigid shape or collapse/fold as needed. Example: A cape that can transform from a rigid shape or collapse behind its wearer. Adjustable airfoil shapes for aircraft and other vehicles.

Examples include: individual, motorized AXIO blocks with integral positioning sensors can use their drive wheels to move toward each other and guide their ball ends into a matching socket end. The receiving socket end's motor will add tension force on the socket to connect the blocks together. The two blocks now can move together and pivot/rotate on their connected ball-and-socket joint. When multiple blocks are connected together by this technique, the blocks can pivot into different shapes by using the drive wheels in the connected joints and also move collectively by assembling articulated leg-like shapes or using their drive wheels.

Various models for both building blocks and connecting blocks (assemble-able into kits and larger shaped items) are envisioned. While some blocks may indicate size arrangements relative to one another and/or relative numbers of connecting means (whether protrusions/pegs or recesses for receiving the latter), it should be understood that such up's and down's are illustrative. In other words, a small I-block may have 2, 4 or more raised elements and its underside recesses for interlocking with one, OR MORE, adjacent blocks (of different varieties—arranged parallel with, perpendicular to or at a desired angle thereagainst. And the total sizes (lengths and widths) of respective blocks are also representative. In production, said PLUS (+) sign along with A, X, I, O and Y shapes may be longer, shorter, wider, etc. And the relative circumferences of the block end ball joints, and their corresponding socket apertures are also quite representative in relative scale.

It will further be appreciated that instead of a set number of partitions and equivalent shaped recessed areas, a greater number, possibly multiples of two or four partitions, might be provided, preferably also with similarly configured recessed areas, to increase the possible angle orientations available to transversely joined blocks. It will further be appreciated that instead of polynomial partitions and recessed areas, circular partitions and matching recessed areas may be provided with each divided into quadrants containing projections and depressions equivalent to those disclosed or suggest above.

Furthermore, other building set elements will be provided with the previously described engagements. The invention is not simply limited to rectangular polyhedron building blocks but further includes other building elements of other shapes and dimensions utilizing the above-described engagements. It is further understood that this invention should not be limited to the specific versions displayed, described and/or disclosed, but still cover modifications within the spirit and scope of the present invention.

Having described the best modes currently known for practicing this system and method, it is to be understood that the scope of this invention may be further described by the attached claims.

SEQUENCE LISTING

Not applicable.

The invention claimed is:

1. A method for connecting and disconnecting two blocks, a first block having at one end a socket with an inwardly curved concave recess for accepting a spherical ball protrusion from a second block, said ball protrusion having at least one of a flat top, a flat upper side and a flat lower side, said block including a plurality of elongate clip arms which when squeezed towards one another assist with: (i) insertion of the spherical ball protrusion of the second block into the inwardly curved concave recess of the socket of the first block, and with (ii) removal of the spherical ball protrusion of the second block from the inwardly curved concave recess of the socket of the first block, said method comprising the steps of:

(a) providing a pair of blocks for connecting to and disconnecting from one another, the first block having at one end the inwardly curved concave recess of the socket for accepting the spherical ball protrusion from the second block, said first block also having the plurality of elongate clip arms which when squeezed towards one another assist with: (i) insertion of the spherical ball protrusion of the second block into the inwardly curved concave recess of the socket of the first block, and with (ii) removal of the spherical ball protrusion of the second block from the inwardly curved concave recess of the socket of the first block;

(b) for connecting the first block to the second block:

(i) situating the spherical ball protrusion of the second block adjacent the inwardly curved concave recess of the socket of the first block;

(ii) squeezing the plurality of elongate clip arms on the first block towards one another;

(iii) inserting the spherical ball protrusion of the second block into the inwardly curved concave recess of the socket of the first block; and (iv) discontinuing the squeezing of the plurality of elongate clip arms on the first block to connect the first block to the second block; and (c) for disconnecting the first block connected to the second block;

(i) squeezing the plurality of elongate clip arms on the first block towards one another; and (ii) removing the spherical ball protrusion of the second block from the inwardly curved concave recess of the socket of the first block.

2. The method of claim 1 wherein the first block is planar, has a spherical ball protrusion at an end opposite the inwardly curved concave recess of the socket end and resembles an A-shaped block.

3. The method of claim 1 wherein the second block is planar, includes a first end and a second end, has a spherical ball protrusion socket at both the first end and the second end and resembles an X-shaped block.

4. The method of claim 1 wherein the first block is radially symmetric, has a spherical ball protrusion at an end opposite the inwardly curved concave recess of the socket end and resembles a conically shaped A-shaped block.

5. The method of claim 4 wherein the plurality of elongate clip arms are included in two or more squeezable side panel aprons.

6. The method of claim 1 wherein the second block is radially symmetric, includes a first end and a second end, has a spherical ball protrusion socket at both the first end and the second end and resembles a double conical block with an X-shaped cross-section.

7. The method of claim 6 wherein the plurality of elongate clip arms are included in two or more squeezable side panel aprons for each end of the double conical block with the X-shaped cross-section.

8. The method of claim 1 wherein the inwardly curved concave recess of the socket of the first block includes at least one expansion joint extending upwardly from an interior point of the socket and allowing for lateral movement when the spherical ball protrusion of the second block is inserted into the socket of the first block.

9. The method of claim 8 wherein the expansion joint is T-shaped.

* * * * *